US010435951B2

(12) United States Patent
Strachan

(10) Patent No.: US 10,435,951 B2
(45) Date of Patent: Oct. 8, 2019

(54) TOOL FACE CONTROL OF A DOWNHOLE TOOL WITH REDUCED DRILL STRING FRICTION

(71) Applicant: HALLIBURTON ENERGY SERVICES, INC., Houston, TX (US)

(72) Inventor: Michael J. Strachan, Conroe, TX (US)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 0 days.

(21) Appl. No.: 15/035,181

(22) PCT Filed: Apr. 29, 2014

(86) PCT No.: PCT/US2014/035873
§ 371 (c)(1),
(2) Date: May 6, 2016

(87) PCT Pub. No.: WO2015/167458
PCT Pub. Date: Nov. 5, 2015

(65) Prior Publication Data
US 2017/0037685 A1 Feb. 9, 2017

(51) Int. Cl.
*E21B 10/00* (2006.01)
*E21B 17/00* (2006.01)
(Continued)

(52) U.S. Cl.
CPC ..... *E21B 7/067* (2013.01); *E21B 4/02* (2013.01); *E21B 4/04* (2013.01); *E21B 4/16* (2013.01);
(Continued)

(58) Field of Classification Search
CPC ..... E21B 4/02; E21B 4/04; E21B 4/16; E21B 7/067; E21B 7/068
See application file for complete search history.

(56) References Cited

U.S. PATENT DOCUMENTS 5,535,835 A 7/1996 Walker
6,047,784 A * 4/2000 Dorel ..... E21B 7/068 175/61
(Continued)

FOREIGN PATENT DOCUMENTS

RU 2239042 C2 10/2004
RU 2428554 C1 9/2011
(Continued)

OTHER PUBLICATIONS

International Search Report and Written Opinion, dated Mar. 24, 2015, 15 pages, Korean Intellectual Property Office.
(Continued)

*Primary Examiner* — David J Bagnell
*Assistant Examiner* — Yanick A Akaragwe

(57) ABSTRACT

A system and method for drilling is disclosed, the system including a drill string with at least one drill pipe, a bottom hole assembly and a drill bit. The bottom hole assembly includes a downhole mud motor for rotating the drill bit, and a steering motor coupled between the mud motor and the drill pipe. The downhole mud motor includes a bent housing. The drill pipe is continuously rotated to minimize friction, regardless of whether the drill bit is turned using rotary drilling or drilling with the downhole mud motor. Tool face orientation may be controlled by operating the steering motor at the drill pipe speed, but in an opposite rotational direction to thereby hold the mud motor and bent housing stationary with respect to the formation. Steering motor speed may be increased or decreased to adjust tool face orientation.

20 Claims, 10 Drawing Sheets

(51) Int. Cl.

| | |
|---|---|
| ***E21B 7/06*** | (2006.01) |
| ***E21B 4/02*** | (2006.01) |
| ***E21B 4/04*** | (2006.01) |
| ***E21B 4/16*** | (2006.01) |
| ***E21B 44/00*** | (2006.01) |
| ***E21B 44/04*** | (2006.01) |
| ***E21B 45/00*** | (2006.01) |
| ***E21B 47/024*** | (2006.01) |
| *E21B 47/06* | (2012.01) |

(52) U.S. Cl.
CPC ..... *E21B 7/068* (2013.01); *E21B 10/00* (2013.01); *E21B 17/003* (2013.01); *E21B 44/005* (2013.01); *E21B 44/04* (2013.01); *E21B 45/00* (2013.01); *E21B 47/024* (2013.01); *E21B 47/06* (2013.01); *E21B 47/065* (2013.01)

(56) References Cited

U.S. PATENT DOCUMENTS

| | | | | |
|---|---|---|---|---|
| 6,092,610 | A | 7/2000 | Kosmala et al. | |
| 7,810,584 | B2 | 10/2010 | Haci et al. | |
| 8,151,907 | B2 | 4/2012 | MacDonald | |
| 2002/0166701 | A1 | 11/2002 | Comeau et al. | |
| 2004/0118612 | A1 | 6/2004 | Haci et al. | |
| 2007/0151767 | A1 | 7/2007 | Downton | |
| 2007/0175662 | A1* | 8/2007 | Kracik | E21B 7/046 175/24 |
| 2008/0066958 | A1 | 3/2008 | Haci et al. | |
| 2009/0090555 | A1* | 4/2009 | Boone | E21B 44/02 175/45 |
| 2010/0212964 | A1* | 8/2010 | Beuershausen | E21B 10/62 175/57 |
| 2012/0024606 | A1* | 2/2012 | Pirovolou | E21B 7/04 175/61 |
| 2012/0031676 | A1 | 2/2012 | Comeau et al. | |
| 2014/0060935 | A1 | 3/2014 | Winslow et al. | |
| 2015/0027781 | A1* | 1/2015 | Vestavik | E21B 21/12 175/57 |
| 2016/0061019 | A1* | 3/2016 | Blange | E21B 41/0085 175/26 |

FOREIGN PATENT DOCUMENTS

| | | | |
|---|---|---|---|
| WO | WO-2013105952 | A1 | 7/2013 |
| WO | WO-2013187860 | A1 | 12/2013 |

OTHER PUBLICATIONS

Patent Office of the Russian Federation, Search Report, dated Jan. 19, 2018, 2 pages, Russia.

* cited by examiner

TOOL FACE CONTROL OF A DOWNHOLE TOOL WITH REDUCED DRILL STRING FRICTION

CROSS-REFERENCE TO RELATED APPLICATIONS

This application is a U.S. national stage patent application of International Patent Application No. PCT/US2014/035873, filed on Apr. 29, 2014, the benefit of which is claimed and the disclosure of which is incorporated herein by reference in its entirety.

TECHNICAL FIELD

The present disclosure relates generally to oilfield equipment, and in particular to downhole tools, drilling systems, and drilling techniques for drilling well bores in the earth. More particularly still, the present disclosure relates to the reduction of drill string friction when drilling using a downhole motor.

BACKGROUND

Steerable drilling systems commonly use a drill string with a drill pipe, a bottom hole assembly, and a drill bit. The bottom hole assembly includes a downhole mud motor powered by drilling fluid to rotate the drill bit and a bent housing to angle the drill bit off centerline. The bottom hole assembly is carried by the drill string, which extends to the earth's surface and provides the drilling fluid to the bottom hole assembly.

For drilling straight sections of the wellbore conventional rotary drilling techniques are typically used. The drill string is rotated from the rig at the surface, and the bottom hole assembly with its downhole mud motor and bent sub are rotated along with the drill string. To drill a curved section of the wellbore, however, the downhole mud motor is used to rotate the bit, and the off-axis bent housing directs the bit away from the axis of the wellbore to provide a slightly curved wellbore section, with the curve achieving the desired deviation or build angle. When drilling curved sections, the drill string is not rotated, but merely slides along the wellbore.

The direction of drilling, or the change in wellbore trajectory, is determined by the tool face angle of the drill bit. The tool face angle is determined by the direction in which the bent housing is oriented. The tool face can be adjusted from the earth's surface by turning the drill string. The operator attempts to maintain the proper tool face angle by applying torque or angle corrections to the drill string using a rotary table or top drive on the drilling rig.

It is a characteristic of directional drilling that a substantial length of the drill string may be in intimate contact with and supported by the wellbore wall, thereby creating a substantial amount of drag. Friction is exacerbated when the drill string is not rotating but is in slide drilling mode. Such drill string friction makes it difficult to apply appropriate weight on bit to achieve an optimal rate of penetration and promotes the stick-slip phenomenon. Additionally, the drill string friction may cause the axial force required to slide the drill string to be so great that the downhole mud motor may stall the instant the drill string breaks free. Moreover, when drill string angle corrections are applied at the surface in an attempt to correct the tool face angle, a substantial amount of the angular change may be absorbed by friction without changing the tool face angle, and stick-slip motion may cause the operator to overshoot the target tool face angle correction.

In some cases, drill string friction can be reduced by rotatively rocking the drill string back and forth between a first angle and a second angle or between opposite torque values. However, the rocking may not sufficiently reduce the friction. Also, the rocking may unintentionally change the tool face angle of the drilling motor, resulting in substantial back and forth wandering of the wellbore, increased wellbore tortuosity, and an increased risk of stuck pipe.

In other cases, a rotary steerable device can be used in place of a downhole mud motor and bent housing. A rotary steerable device applies a modulated off-axis biasing force to the bit in the desired direction in order to steer a directional well while the entire drill string is rotating. As a result, the desired tool face and bend angle may be maintained while minimizing drill string friction. When steering is not desired, the rotary steerable device is set to turn off the off-axis bias. Because there is no drill string sliding motion involved with the rotary steerable system, the traditional problems related to sliding, such as stick-slip and drag problems, are greatly reduced. However, rotary steerable devices may be complex and costly.

BRIEF DESCRIPTION OF THE DRAWINGS

Embodiments are described in detail hereinafter with reference to the accompanying figures, in which.

DETAILED DESCRIPTION

Figure 1:
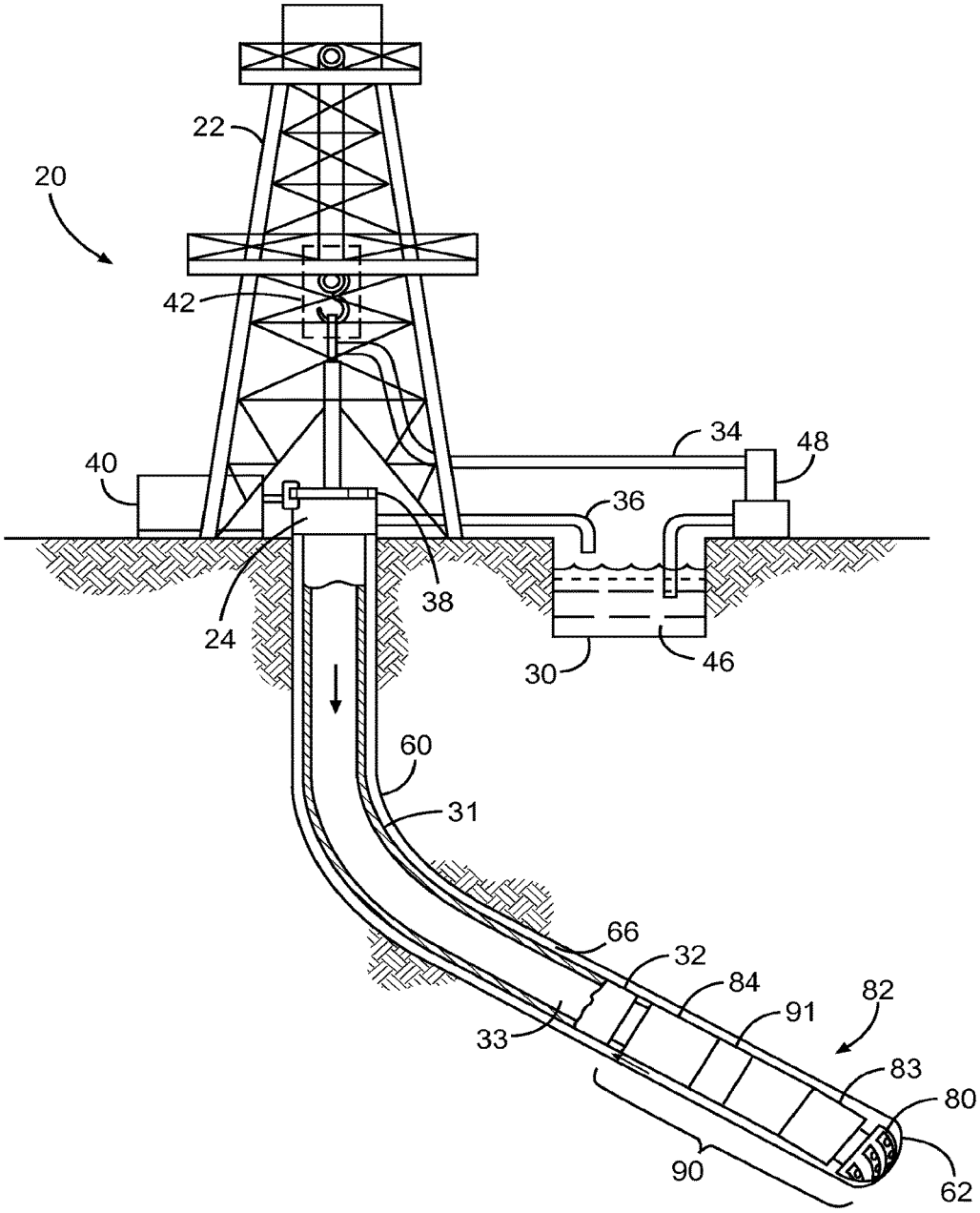
FIG. 1 is a diagram illustrating an example drilling system, according to aspects of the present disclosure.

The present disclosure may repeat reference numerals and/or letters in the various examples. This repetition is for the purpose of simplicity and clarity and does not in itself dictate a relationship between the various embodiments and/or configurations discussed. As used herein, the verbs "to couple" and "to connect" and their conjugates may include both direct and indirect connection.

Spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

FIG. 1 is an elevation view in partial cross-section of a drilling system 20 including a bottom hole assembly 90 according to an embodiment. Drilling system 20 may include a land drilling rig 22. However, teachings of the present disclosure may be satisfactorily used in association with offshore platforms, semi-submersible, drill ships and any other drilling system satisfactory for forming a wellbore extending through one or more downhole formations.

Drilling rig 22 may be located proximate to a well head 24. Drilling rig 22 may include a rotary table 38, a rotary drive motor 40 and other equipment associated with rotation of a drill string 32 within a wellbore 60. An annulus 66 is formed between the exterior of drill string 32 and the inside diameter of a wellbore 60. For some applications drilling rig 22 may also include a top drive 42. Blowout preventers (not expressly shown) and other equipment associated with drilling a wellbore may also be provided at well head 24.

The lower end of drill string 32 includes bottom hole assembly 90, which carries at a distal end a rotary drill bit 80. Drilling fluid 46 may be pumped from a reservoir 30 by one or more pumps 48, through a conduit 34, and to the upper end of drill string 32 extending out of well head 24. The drilling fluid 46 then flows through the longitudinal interior 33 of drill string 32, through bottom hole assembly 90, and exits from nozzles formed in rotary drill bit 80. At the bottom end 62 of wellbore 60, drilling fluid 46 may mix with formation cuttings and other downhole fluids and debris. The drilling fluid mixture then flows upwardly through annulus 66 to return formation cuttings and other downhole debris to the surface. A conduit 36 may return the fluid to reservoir 30, but various types of screens, filters and/or centrifuges (not expressly shown) may be provided to remove formation cuttings and other downhole debris prior to returning drilling fluid to reservoir 30. Various types of pipes, tube and/or hoses may be used to form conduits 34 and 36.

According to an embodiment, bottom hole assembly 90 includes a downhole mud motor 82, which includes a bent housing 83. Downhole mud motor 82 is coupled to and driven by a steering motor 84. In an embodiment, steering motor 84 is an electric motor. Bottom hole assembly 90 may also include various other tools 91, such as those that provide logging or measurement data and other information from the bottom of wellbore 60. Measurement data and other information may be communicated from end 62 of wellbore 60 using measurement while drilling techniques and converted to electrical signals at the well surface to, among other things, monitor the performance of drilling string 32, bottom hole assembly 90, and associated rotary drill bit 80.

Figure 2:
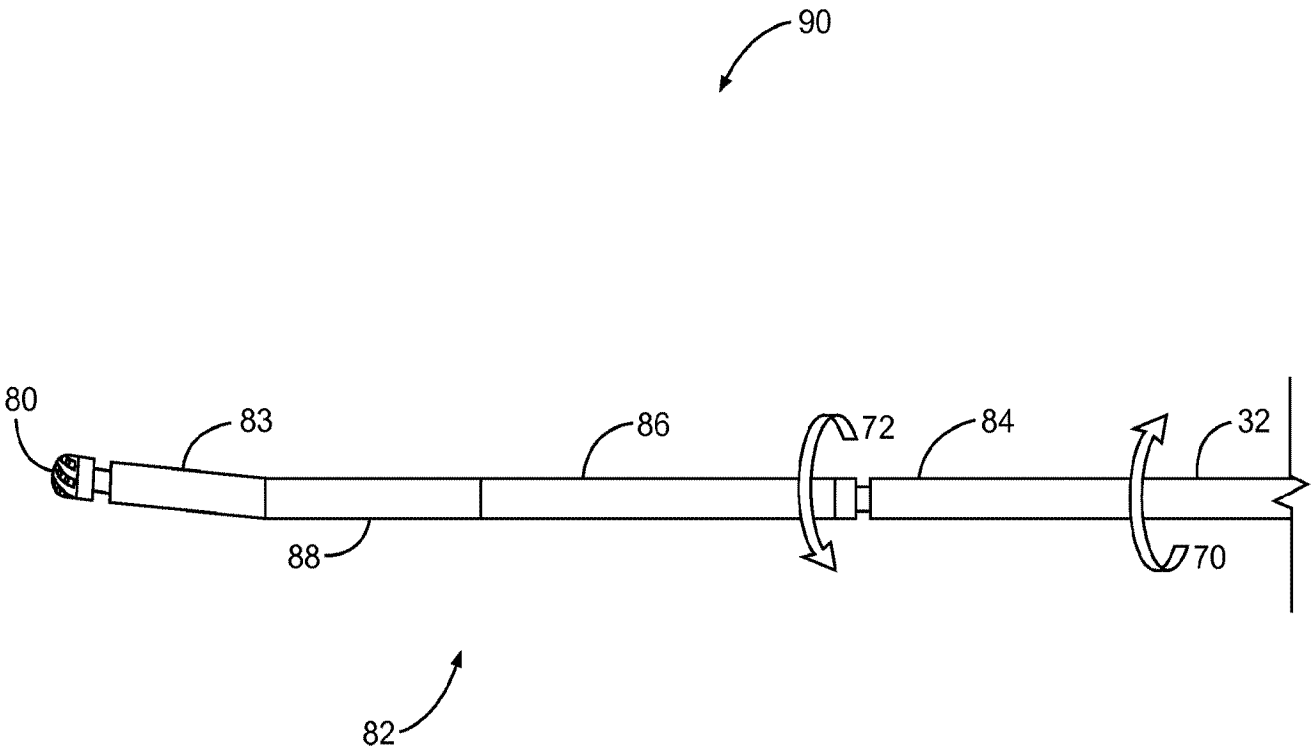
FIG. 2 is a diagram illustrating the bottom hole assembly of FIG. 1, according to aspects of the present disclosure.

FIG. 2 is an elevation view of bottom hole assembly 90 that includes a downhole mud motor 82, which may in turn include an upper power section 86 and a lower bearing section 88. Power section 86 may be a positive displacement motor of the Moineau type, which uses a lobed spiraling rotor that orbits and rotates within an elastomeric stator having one lobe more than the rotor. The rotor is driven to rotate by a differential fluid pressure across the power section. Such mud motors are capable of producing high torque and lower speeds that are generally desirable for steerable applications. Alternatively, power section 86 may include a vaned drilling-fluid-powered turbine, also referred to as a turbodrill, which operates at high speeds and low torque. Lower bearing section 88 includes thrust and radial bearings (not illustrated). Lower bearing section 88 may include a rotor (not illustrated) with upper and lower constant velocity joints that connects the rotor of power section 86 to drill bit 80 for rotation thereof. Constant velocity shafts allow for the off-axis bend of the housing of mud motor 82, as well as for nutation of the Moineau-style rotor.

Bottom hole assembly 90 includes a steering motor 84. Steering motor 84 may be a fluid-powered motor, such as a positive displacement Moineau or turbodrill motor, as described above, or an electric motor. Steering motor 84 is coupled to and drives downhole mud motor 82. Steering motor 84 is, in turn, coupled to and driven by the drill pipe 31 of drill string 32. In one embodiment, the stator of steering motor 84 is connected to drill pipe 31, and the rotor of steering motor 84 is connected to downhole mud motor 82. In another embodiment, the rotor of steering motor 84 is connected to drill pipe 31, and the stator of steering motor 84 is connected to downhole mud motor 82.

Although the embodiments presented herein are discussed in terms of using drill pipe, one skilled in the art recognizes that other means of conveyance, such as coiled tubing, may also be substituted and is covered herein within the meaning of the term drill pipe.

In operation, drill pipe 31 rotates in a first direction, as indicated by arrow 70, which in turn rotates the stator or steering motor 84 in the first direction. When drilling straight wellbore sections, steering motor 84 is not powered, and its rotor does not rotate relative to its stator. Similarly, downhole mud motor 82 is de-energized. Accordingly, as drill string 32 rotates in first direction 70, drill bit 80 rotates in direction 70 in a conventional rotary drilling manner. However, when drilling curved wellbore sections, as drill pipe 31 rotates in first direction 70, steering motor 84 rotates in the direction opposite to first direction, as indicated by arrow 72, at a rotational speed equal to the speed of drill pipe 31. As a result, downhole mud motor 82 and the tool face of drill bit 80 are held stationary with respect to the formation even as drill pipe 31 rotates. Drill string friction is greatly reduced because of the continuous drill pipe rotation. In addition, hole-cleaning characteristics are greatly improved because the continuous drill pipe rotation facilitates better cuttings removal.

In one embodiment, the rotational speed of steering motor 84, or the speed of drill pipe 31, may be periodically adjusted to provide a tiny mismatch in speed—either higher or lower—with respect to the speed of the other. In this manner, the tool face of drill bit 80 can be slowly rotated, oriented, and readjusted as necessary. Once the tool face angle is correct, the speeds of steering motor 84 and drill pipe 31 are again matched, and the tool face angle is held stationary.

Various sensor and motor control systems, discussed in greater detail below, may be used to regulate the speed of steering motor 84. For example, the speed and/or torque of drill pipe 31 may be measured and balanced. Traditional orienting instrumentation systems for maintaining tool face may be readily adaptable to control steering motor 84.

Figure 3:
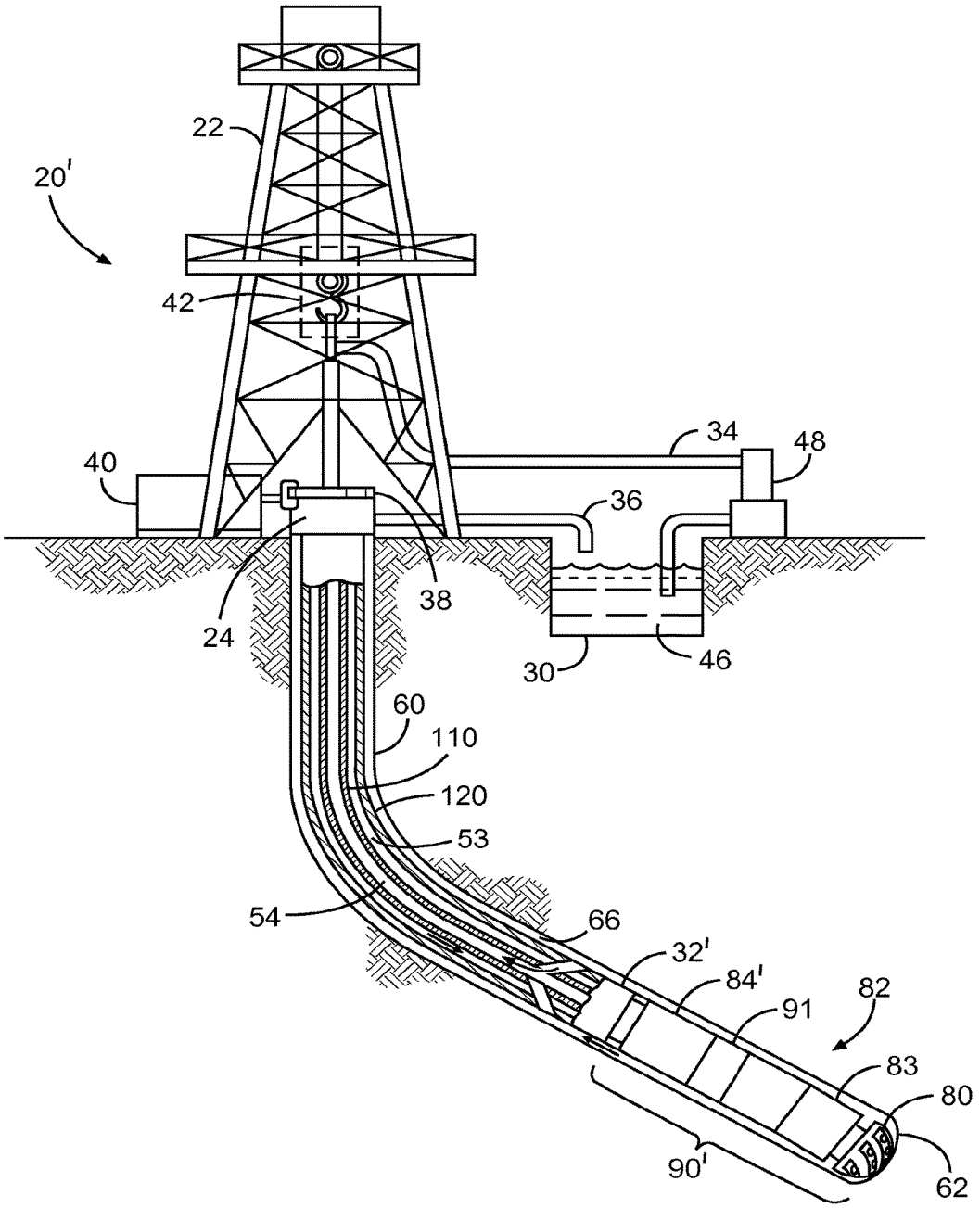
FIG. 3 is a diagram illustrating another example drilling system, according to aspects of the present disclosure.

FIG. 3 is an elevation view in partial cross-section of a drilling system 20' that includes a bottom hole assembly 90' according to an embodiment in which a Reelwell drilling method pipe-in-pipe drill string 32' is used in place of the conventional drill string 32 of FIG. 1. Drill string 32' includes an inner pipe 110 that is coaxially disposed within an outer pipe 120. Inner pipe 110 and outer pipe 120 may be eccentric or concentric. An annular flow path 53 is defined between inner pipe 110 and outer pipe 120, and an inner flow path 54 is defined within the interior of inner pipe 110. Moreover, annulus 66 is defined between the exterior of drill string 32' and the inside wall of wellbore 60. A flow diverter 210 located near the distal end of drill string 32' fluidly connects annulus 66 with inner flow path 54.

As with drilling system 20 of FIG. 1, drilling system 20' of FIG. 3 may include drilling rig 22 located on land, an offshore platform, semi-submersible, drill ship or the like. Drilling rig 22 may be located proximate well head 24 and may include rotary table 38, rotary drive motor 40 and other equipment associated with rotation of drill string 32' within wellbore 60. For some applications drilling rig 22 may include top drive motor or top drive unit 42. Blow out preventers (not expressly shown) and other equipment associated with drilling a wellbore may also be provided at well head 24.

The lower end of drill string 32' includes bottom hole assembly 90', which at a distal end carries a rotary drill bit 80. Drilling fluid 46 may be pumped from reservoir 30 by one or more pumps 48, through conduit 34, to the upper end of drill string 32' extending out of well head 24. The drilling fluid 46 then flows through the annular flow path 53 between inner pipe 110 and outer pipe 120, through bottom hole assembly 90', and exits from nozzles formed in rotary drill bit 80. At bottom end 62 of wellbore 60, drilling fluid 46 may mix with formation cuttings and other downhole fluids and debris. The drilling fluid mixture then flows upwardly through annulus 66, through flow diverter 210, and upwards through the inner flow path 54 provided by inner pipe 110 to return formation cuttings and other downhole debris to the surface. Conduit 36 may return the fluid to reservoir 30, but various types of screens, filters and/or centrifuges (not expressly shown) may be provided to remove formation cuttings and other downhole debris prior to returning drilling fluid to pit 30. Various types of pipes, tube and/or hoses may be used to form conduits 34 and 36.

Figure 4:
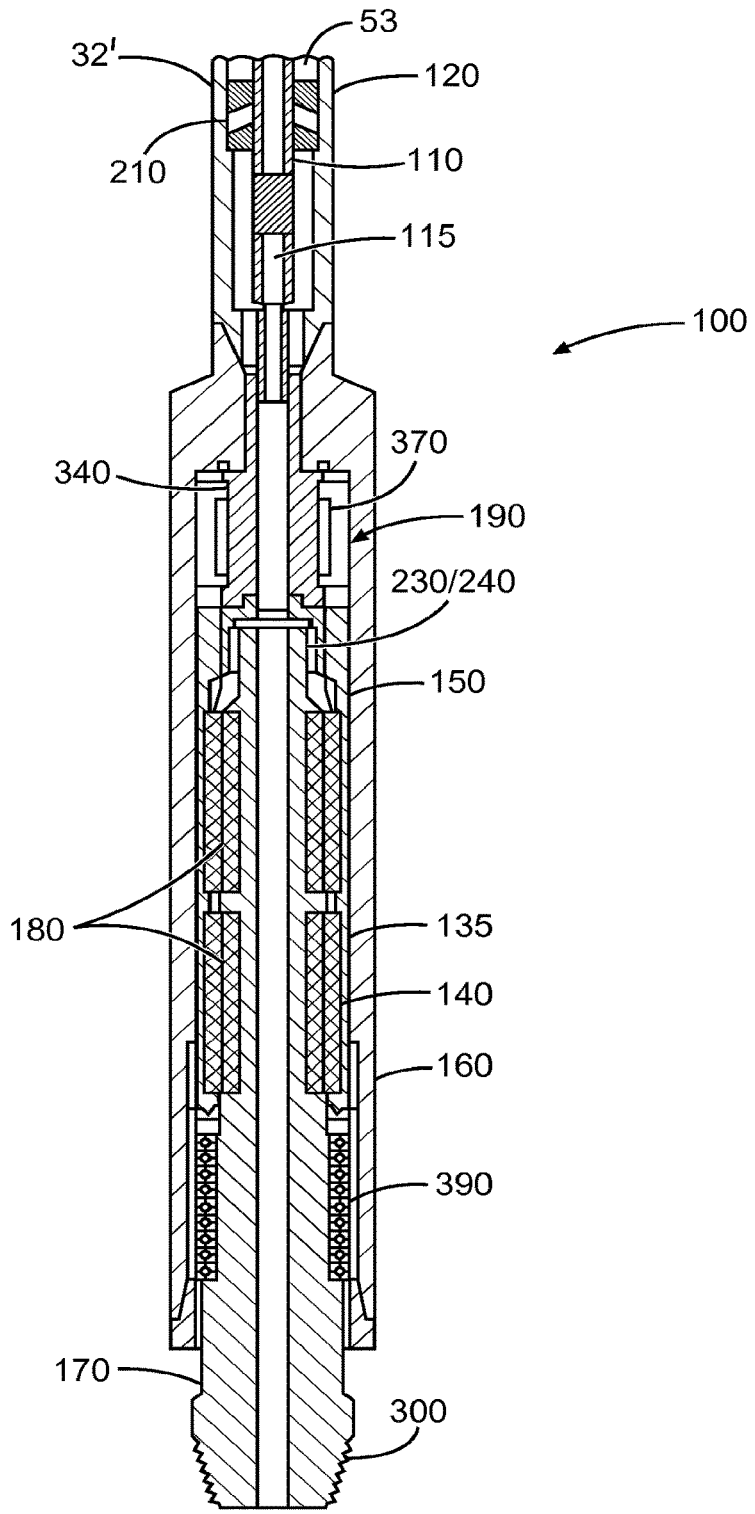
FIG. 4 is a diagram illustrating an example electric steering motor, according to aspects of the present disclosure.

FIG. 4 is an axial cross-section of an electric steering motor 84' in accordance with an embodiment. Electric steering motor 84' has variable speed and torque capability. Optional planetary gearing (not illustrated) may also be provided to facilitate desired speed and torque output.

Electric steering motor 84' may be connected as part of pipe-in-pipe drill string 32', which includes inner pipe 110, outer pipe 120, and flow diverter 210. Electric steering motor 84' may include motor housing 160, stator assembly 150 having stator windings 140, rotor 170 having rotor magnets 180, electronics insert 340 that carries motor controller 370, and flow restrictor 230, as described in greater detail below.

In certain embodiments, electrical power, either provided as direct current or single phase alternating current, may be transmitted by inner pipe 110 and outer pipe 120 from the surface along the length of drill string 32'. Inner pipe 110 is the "hot" power conductor and outer pipe 120 is grounded, because outer pipe 120 is likely to be in conductive contact with the grounded drilling rig. The outer surface of inner pipe 110 and/or the inner surface of outer pipe 120 may be coated with an electrical insulating material (not expressly shown) to prevent short circuiting of the inner pipe 110 through the drilling fluid or other contact points to the outer pipe 120. Examples of dielectric insulating materials include polyimide, polytetrafluoroethylene or other fluoropolymers, nylon, and ceramic coatings. The bare metal of inner pipe 110 is exposed only in areas sealed and protected from the drilling fluid. The bare metal of inner pipe 110 may be exposed only to make electrical connections along the length of drill string 32' to the next joint of inner pipe. Such areas may be filled with air or a non-electrically conductive fluid, such as a dielectric oil, or a conductive fluid, such as water-based drilling fluids, so long as there is no path for the electric current to short circuit from inner pipe 110 to outer pipe 120.

Figure 5:
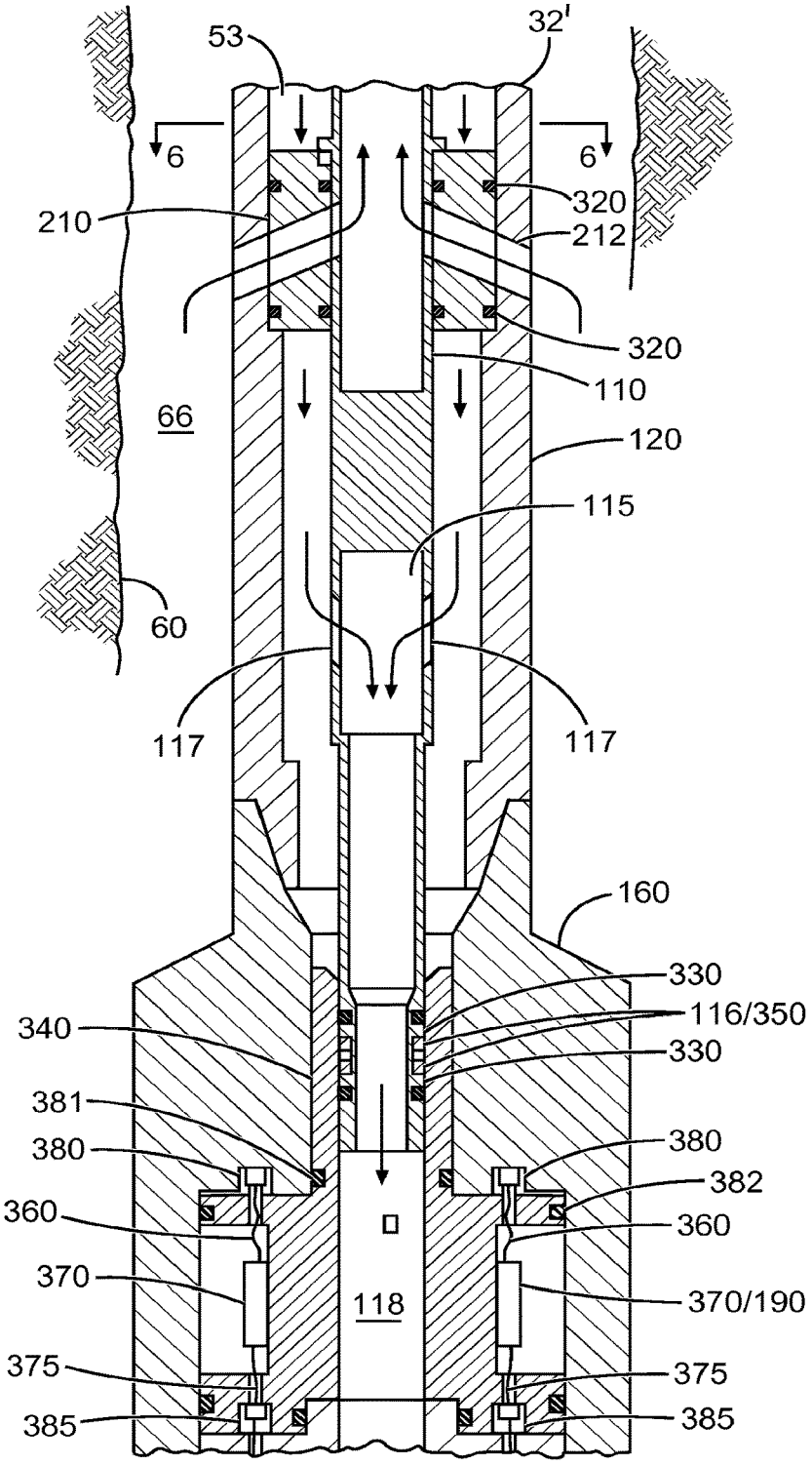
FIG. 5 is a diagram illustrating an example flow diverter, according to aspects of the present disclosure.
Figure 6:
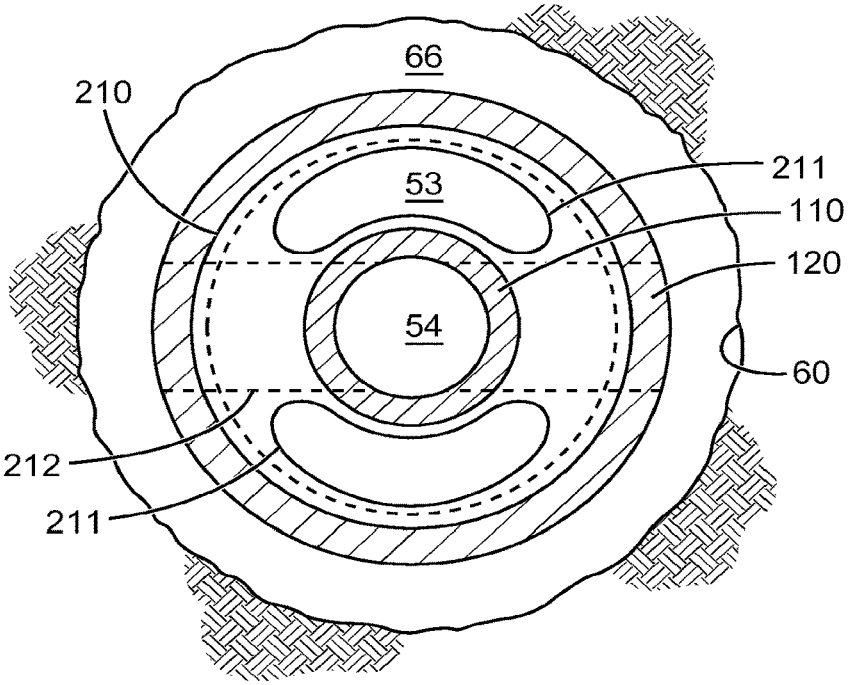
FIG. 6 is another diagram illustrating an example flow diverter, according to aspects of the present disclosure.

FIG. 5 is a detailed axial cross section of a lower portion of drill string 32' and an upper portion of electric steering motor 84', showing flow diverter 210 of FIG. 4. FIG. 6 is a transverse cross section taken along line 6-6 of FIG. 5 showing the top of flow diverter 210. Referring to FIGS. 4-6, flow diverter 210 is disposed near the top of electric steering motor 84'. Flow diverter 210 electrically insulates outer pipe 120 from inner pipe 110. Flow diverter 210 may be made of ceramic or a metal alloy with a dielectric insulating coating. Ceramics offer a high erosion resistance to flowing sand, cuttings, junk and other solids flowing from annulus 66 to the inner flow path 54 provided by inner pipe 110 on the flow return path to the surface. Ceramics made by companies like CARBO Ceramics® are characterized by useful molding techniques that may be suitable for forming flow diverter 210.

Seals 320 may be located on the top and bottom of flow diverter 210 to prevent annular flow between inner pipe 110 and outer pipe 120 from leaking into the center of inner pipe 110. Flow diverter 210 may be keyed to inner pipe 110 and outer pipe 120 so as to maintain proper rotational alignment.

During operation, drilling fluid 46 (FIG. 3) flows down annular flow path 53 between inner pipe 110 and outer pipe 120 and through kidney-shaped passages 211 within flow diverter 210. Concurrently, drilling fluid and earthen cuttings from annulus 66 formed between wellbore 60 and outer pipe 120 enters inner pipe 110 via crossover ports 212. Inner pipe 110 is capped or plugged at or just below flow diverter 210 so that fluid from annulus 66 can only flow upwards within inner pipe 110.

Below flow diverter 210, downward flowing drilling fluid may be diverted into a lower central passage 115 of inner pipe 110 through ports 117. At this point the downward flowing drilling fluid 46 passes out of inner pipe 110 and into a longitudinal central conduit 118 formed within steering motor 84'.

In an embodiment, inner pipe 110 has an electrically insulating coating along its exterior length except for a contact 116 located within a sealed wet connect area 330. Contact 116 is a short section of non-insulated inner pipe 110, which is mated with an electronics insert 340 to provide electrical current to electric steering motor 84' via motor controller 370. The electronics insert 340 may be also electrically insulated with a coating except for the area that mates with contact 116. An electrically conductive wire wound spring 350 may be used to encourage the electrical connection between inner pipe 110 and electronics insert 340. Although not expressly illustrated, electronics insert 340 may have orientation dowels, detents or the like to maintain proper rotational alignment.

Motor controller 370, which is carried by electronics insert 340, may be positioned above stator windings 140 to control the speed, torque, and as other various aspects of electric steering motor 84'. Electronic assembly 370 may be capable of bidirectional communication with the surface via signals superpositioned with the electric power carried by the two-conductor path formed by inner pipe 110 and outer pipe 120. Additionally, electronic assembly 370 may pass along communications and data between the surface and modules positioned below the motor to support logging while drilling and/or measurement while drilling, steering, and like systems. Feed-through conductors 375 may support such communications.

Motor controller 370 may be housed inside a pressure-controlled cavity to protect the electronics. Motor controller 370 may be coated with a ceramic coating to allow for the cavity to be oil filled and pressure balanced with its surrounding environment, thereby allowing for a thinner housing wall, leaving more space for the electronics, and providing for better cooling of the electronics.

Conductors 375, which are stuffed through glands at sealed bulkhead interfaces 385, lead out to the stator windings 140 and optional sensors below. Electronics insert 340 may include one or more ground lines 360, which are stuffed through glands at sealed bulkhead interfaces 380. Ground lines 360 provide a return electrical path to outer pipe 120. Ground lines 360 may be sealed from the drilling fluid by O-rings 381 and 382 or by other means to prevent damage from corrosive conditions.

Figure 7:
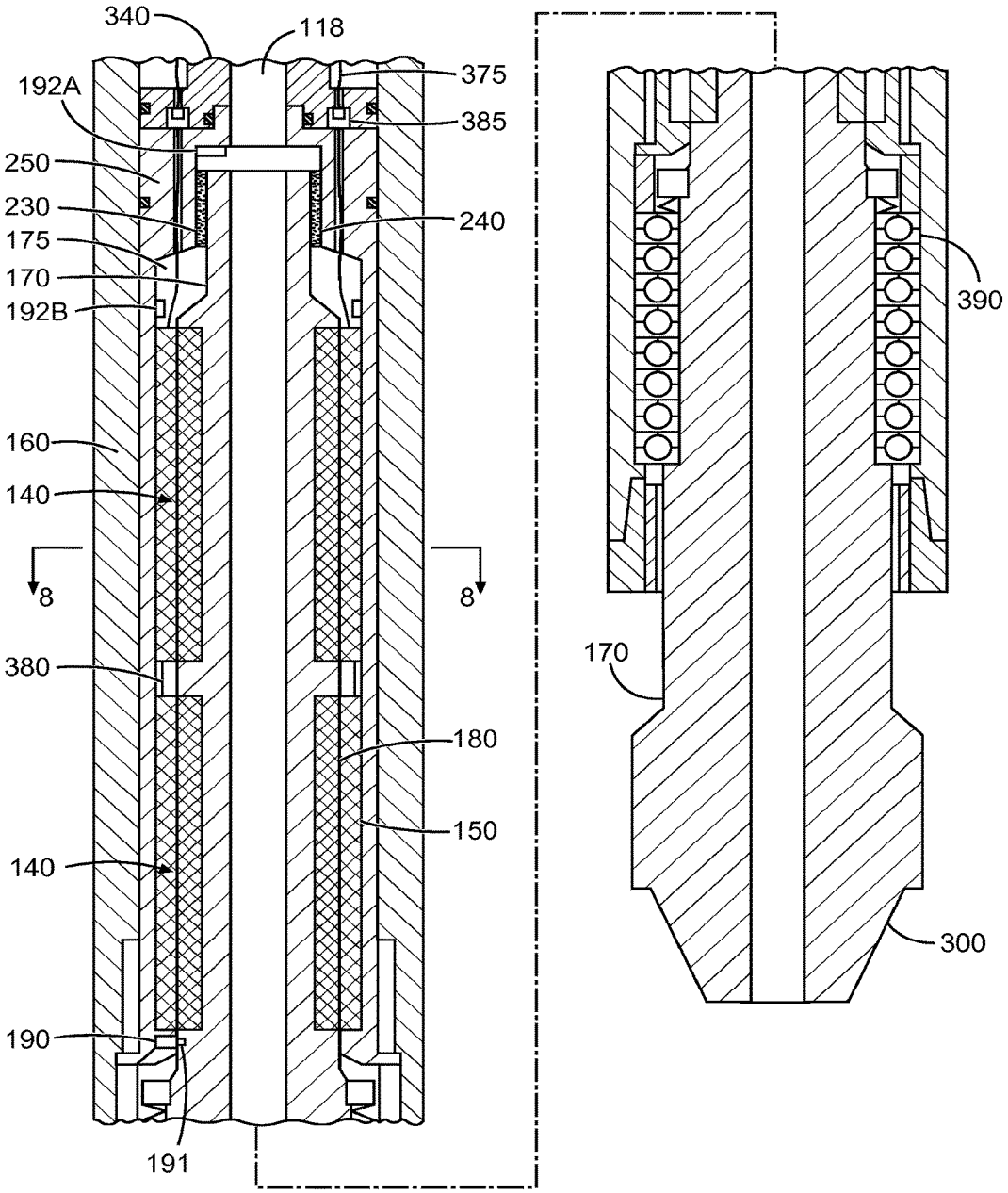
FIG. 7 is a diagram illustrating elements of an example electric steering motor, according to aspects of the present disclosure.

FIG. 7 is an axial cross section of middle and lower portions of electric steering motor 84'. Referring to FIGS. 4 and 7, drilling fluid 46 (FIG. 3) flows down the center of the electronics insert 340 through central passage 118. At this point the downward flowing drilling fluid splits into two flow paths. A first flow path continues down central passage 118 within rotor 170, and ultimately down to downhole mud motor 82 and drill bit 80 at the bottom of the drill string 32', where it exits drill bit 80 and begins its way back up through the wellbore annulus 66 (FIG. 3) to the flow diverter crossover ports 212. A second flow path is defined through a flow restrictor 230 located at or near the top of rotor 170, through the gap between the outer circumference of rotor 170 and the inner circumference of stator assembly 150, and through the bearing assembly 390, eventually exiting electric steering motor 84' at the bottom of motor housing 160.

Flow restrictor 230 is designed to pass a small amount of drilling fluid to cool stator windings 140 and lubricate lower radial and thrust bearing assembly 390 of the electric steering motor 84'. For example, flow restrictor 230 may have a small gap flow path formed therethrough to allow for drilling fluid flow. Flow restrictor 230 may be made of erosion-resistant material such as tungsten carbide or a cobalt-based alloy like Stellite. In an embodiment, flow restrictor 230 may also double as an upper radial bearing 240. In other embodiments, a separate upper radial bearing may be provided. Radial bearing 240 may include marine rubber, polycrystalline diamond compact, fused tungsten carbide, or other suitable coatings or bearing materials.

Although shown as located at the top of rotor 170, flow restrictor 230 may be positioned anywhere along either flow path so long as it appropriately proportions drilling fluid flow between the two flow paths to provide adequate stator cooling and bearing lubrication while maintaining ample drilling fluid flow to downhole mud motor 82 and drill bit 80 (FIG. 3).

An optional mid-radial bearing 380 may be provided, which may be lubricated by drilling fluid flow as described above. An elastomeric marine bearing, roller, ball, journal or other type bearing may be used for mid-radial bearing 380. A lower bearing assembly 390 may be provided for radial and axial support to rotor 170.

Rotor 170 extends beyond the bottom of motor housing 160 and terminates in a connector 300 to drive to downhole motor 82 (FIG. 3). Although connector 300 is shown as a pin connector, a box connector, spline, or other suitable coupling may be used as appropriate.

Figure 8:
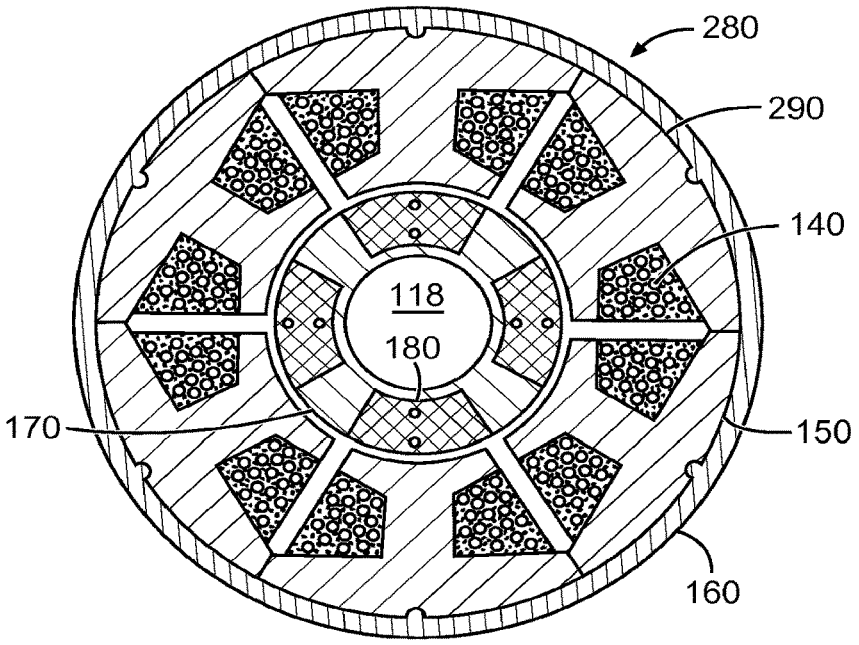
FIG. 8 is another diagram illustrating an enlarged cross-sectional view taken along the line 8-8 of FIG. 7, showing an example stator and rotor arrangement of an electric steering motor.

FIG. 8 is a transverse cross-section taken along line 8-8 of FIG. 7. Referring now to FIGS. 4, 7, and 8, stator windings 140 may be wound in a pie wedge fashion within stator assembly 150. Stator assembly 150 may include a stator head 290 machined from a single round tube, but for ease of manufacturing, a number of discrete wedge-shaped stator heads 290 may be provided, with stator windings 140 being wrapped about the individual stator heads 290. Individual stator heads 290, which may be welded together, are then assembled within motor housing 160. Stator assembly 150 is fixed within the motor housing 160 to prevent relative rotation. For instance, stator head(s) 290 may be grooved on the outer diameter and may be keyed with motor housing 160 to prevent rotation therebetween.

Stator head(s) 290 are made of a soft iron with a high permeability. Stator windings 140 may be formed using magnetic wire, which may be made of silver, copper, aluminum, or any conductive element, coated with varnish, polyether ether ketone (PEEK), or other dielectric material. Stator windings 140 may make many wraps around stator heads 290. Optionally, a potting material, such as a ceramic, rubber, or high temperature epoxy, may be disposed over the top of and/or embedded into the stator windings 140. This potting material may be used to protect the stator windings 140 from corrosion and erosion from contact with drilling fluid. Further, the potting provides additional short circuit protection above the basic coating provided by the magnetic wire.

Steering motor 84' may include fixed permanent rotor magnets 180 mounted on rotor 170 in such a manner as to maximize reactive torque. An advantage of permanent rotor magnets 180 is high torque delivery and precise control of rotor speed without slip or the need for slip rings or commutation. However, rotor 170 may use current-carrying windings in place of permanent magnets 180 as appropriate. For example, a short-circuited induction squirrel cage rotor or a rotor winding that receives current via slip rings or commutators may be used.

Electric steering motor 84' is shown as having six poles, with four permanent rotor magnets 180 mounted on rotor 170. However, variations in the motor type, the number of poles, commutation methods, control means, and winding and/or magnet arrangements may be used as appropriate. For example, the number of windings and magnets can be scaled, such as twelve stator poles and eight rotor magnets or three stator poles and two rotor magnets. Appropriate combinations depend upon several factors, including reliability, smoothness, and peak torque requirements.

Rotor magnets 180 are characterized by a high magnetic field strength. Suitable types of rotor magnets 180 may include samarium cobalt magnets. In certain embodiments, rotor magnets 180 may be manufactured in a wedge shape to match pockets formed within rotor 170, although other shapes may be used as appropriate. Rotor magnets 180 may also be made by pouring into a mold a loose powder of fine magnetic particles which is then pressed and sintered in the mold. A magnetic field may be applied during this manufacturing process to align the magnetic domains of the individual particles to an optimal orientation. The polarity of the rotor magnets 180 may be alternated with the north pole and south poles facing outwards. Once the rotor magnets 180 are set, they may be fastened to the rotor 170, if not sintered in place, through various means such as retainer bands, sleeves, screws, slots or other fasteners.

Figure 9:
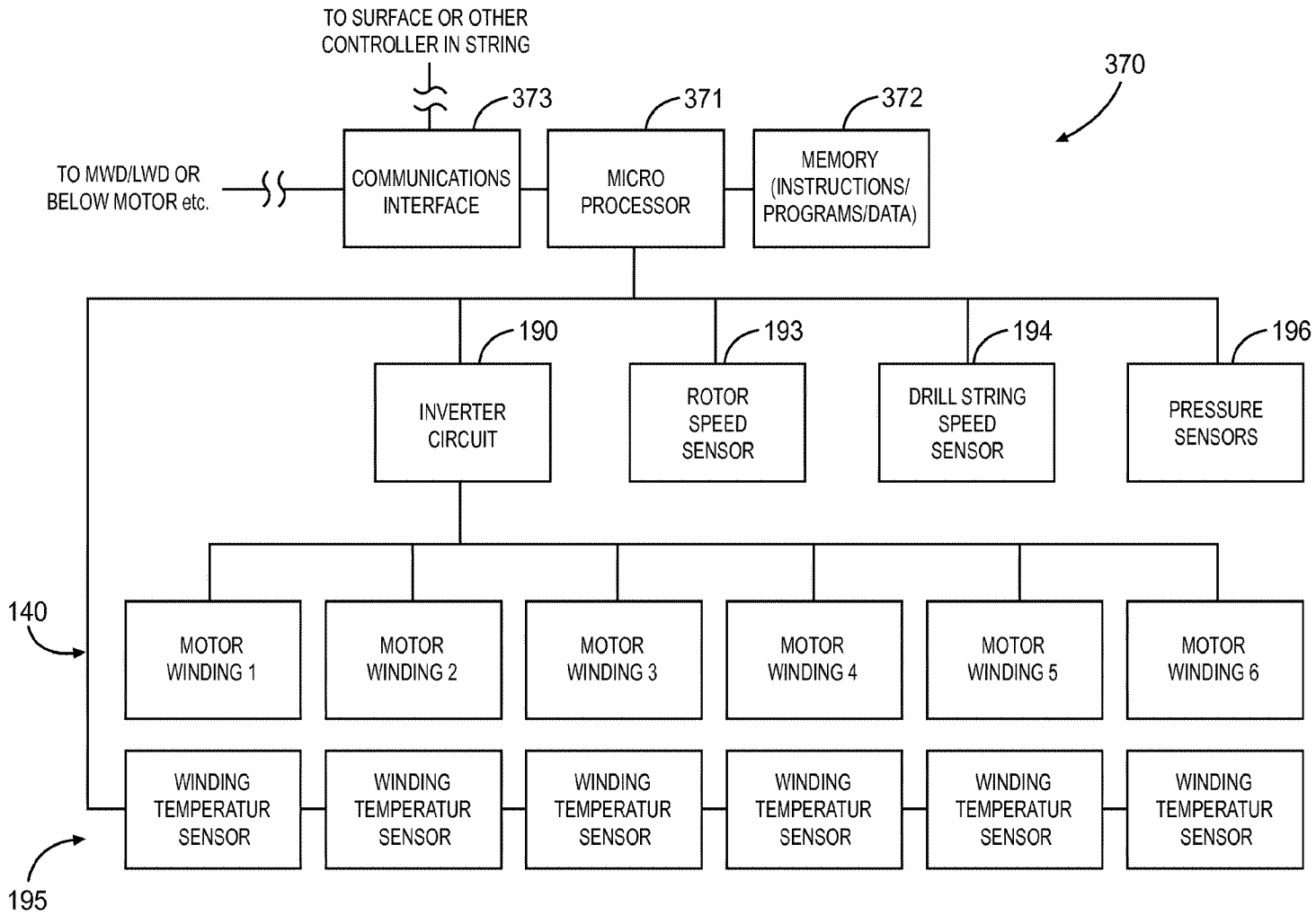
FIG. 9 is a block diagram of an motor controller for controlling the electric steering motor, according to aspects of the present disclosure.

FIG. 9 is a block diagram of motor controller 370 according to an embodiment. Motor controller 370 ideally includes a processor 371 with memory 372 for monitoring, and controlling the electric steering motor 84'. Processor 371 may control several functions, including but not limited to motor starting, shaft speed, output torque, and winding temperature and/or drilling fluid flow monitoring. Additionally, processor 371 may control transmission of motor data and reception of drill pipe torque and speed data via a communications interface 373. Communications interface 373 may communicate over inner pipe 110 and outer pipe 120 through the use of slip rings or inductive couplings. Communications interface 373 may also relay control signals and measurement data, for example, between the surface and devices located below electric steering motor 84' within BHA 90'.

Processor 371 may execute commands that are stored in memory 372. Memory 372 may be collocated on an integral semiconductor with processor 371 and/or exist as one or more separate memory devices, including random access memory, flash memory, magnetic or optical memory, or other forms. Memory 372 may also be used for logging performance information about electric steering motor 84' such as winding temperature, drilling fluid temperature, shaft speed, power output, torque output, voltage, winding current, and pressure on either side of flow restrictor 230 (FIG. 6).

In certain embodiments, a rotor speed sensor 193 may be provided to monitor shaft position and/or speed. For example, a hall effect device may be provided to monitor shaft position and RPM by sensing rotor magnets 180. The signal output of the rotor speed sensor 193 may be routed to the motor controller 370 where processor 371 can automatically assess and adjust the rotor speed. Further, by monitoring the position of rotor 170 while it rotates, torque delivery may be optimized and pole slippage detected.

In an embodiment, a drill string speed sensor 194, such as an inertial sensor or the like may be provided within electric steering motor 84' or elsewhere within bottom hole assembly 90' to determine the rotational speed of drill string 32'. In this manner, the speed of electric steering motor 84' can be controlled by motor controller 370 so that the speed of rotor 170 is equal in magnitude and opposite in direction from the speed of drill string 32'. The speed of electric steering motor 84' can be so controlled to, for example, maintain a constant tool face orientation. Alternatively, a tool face orientation sensor (not illustrated), which may also be an inertial sensor, may detect the tool face orientation directly and provide feedback to motor controller 370 for control of the speed of rotor 170. In yet another embodiment, the speed and or torque of drill string 32' is provided by other means and communicated to motor controller 370 via communications interface 373, which in turn controls the torque and/or speed output of electric steering motor 84'.

In one embodiment, the rotational speed of steering motor 84, or the speed of drill string 32', may be periodically adjusted to provide a tiny mismatch in speed—either higher or lower—with respect to the speed of the other. In this manner, the tool face of drill bit 80 can be slowly rotated, oriented, and readjusted as necessary. Once the tool face angle is correct, the speeds of steering motor 84 and drill string 32' are again matched, and the tool face angle is held stationary.

In certain embodiments, temperature sensors 195 may also be provided adjacent to or embedded with windings 140. At least one temperature sensor 195 for each winding 140 may be used to monitor the motor temperature. Furthermore, in certain embodiments, pressure sensors 196 may be provided above and below flow restrictor 230 (FIG. 7) to monitor drilling fluid flow.

Figure 10:
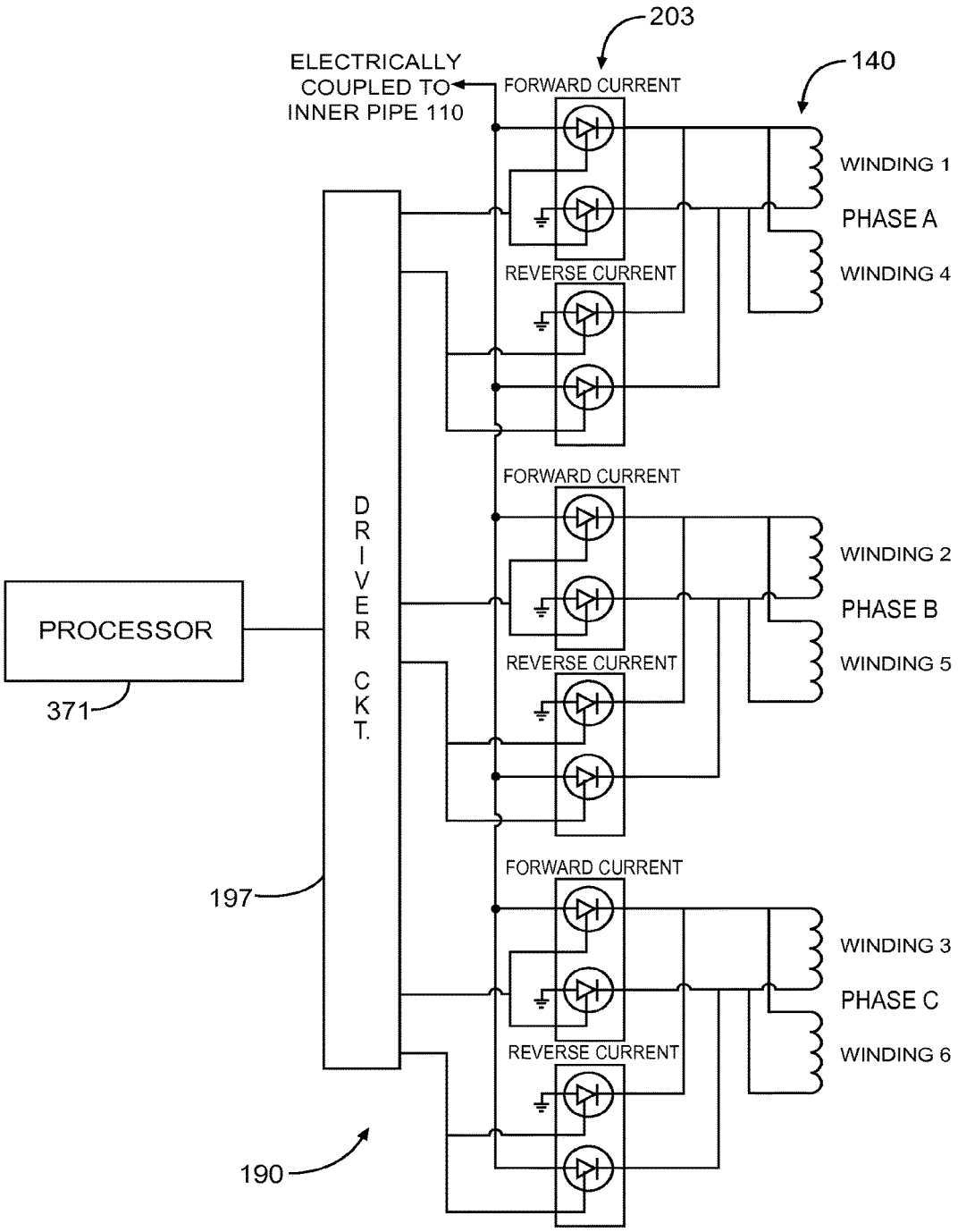
FIG. 10 is a schematic diagram showing an example a inverter circuit of a motor controller.

According to an embodiment, processor 371 controls electric steering motor 84' via an inverter circuit 190. FIG. 10 is an upper level schematic diagram of one possible inverter circuit 190. Referring to FIGS. 9 and 10, inverter circuit 190 may convert DC power provided by inner pipe 110 and outer pipe 120 (FIGS. 3 and 4) to three-phase power. If single phase AC power is provided by pipes 110, 120 rather than DC power, then the inverter circuit 190 may be substantially the same as that illustrated in FIG. 10, except it may include a rectifier to first convert the alternating current to direct current.

Inverter circuit 190 uses solid state electronics for switching and alternating the polarity of current to pairs of windings 140. Suitable solid state electronics may include semiconductor based switches 203 such as silicon controlled rectifiers (SCR), insulated-gate bipolar transistors (IGBT), thyristors, and the like. Winding pairs may be physically opposite to each other in the motor as shown in FIG. 8 with the phase relationship of each pair being 120° out of phase with any adjacent winding pair. Each winding pair may be connected in parallel or in series as appropriate, and the three phases may be connected in a delta or a wye configuration.

In order to maximize motor power, an approximated sinusoidal power waveform may be generated by processor 371 and inverter circuit 190. However, other waveform shapes such as square or saw tooth, may be used as appropriate. Processor 371 and inverter circuit 190 cooperate to provide the desired direction of rotation, maintain phase separation of each winding pair, set the frequency (including ramping the frequency up and down at acceptable rates when changing motor speed), and control power levels to the windings to optimize torque delivery at given speeds. Each of these functions may be accomplished by varying the supplied current, voltage, or both, to the winding pairs and/or varying the duty cycle of each wave cycle.

Microprocessor 371 may maintain the pulse width and phase angle for all three phases of power and send timing signals to inverter circuit 190 to generate the power signals applied to windings 140. In an embodiment, a driver circuit 197 is provided as part of inverter circuit 190 to interface processor 371 to the high power switching devices 203. Driver circuit 197 may be a small power amplifier switch used to source enough power to turn the semi-conductor switches 203 on and off based on logic outputs from processor 371.

Figure 11:
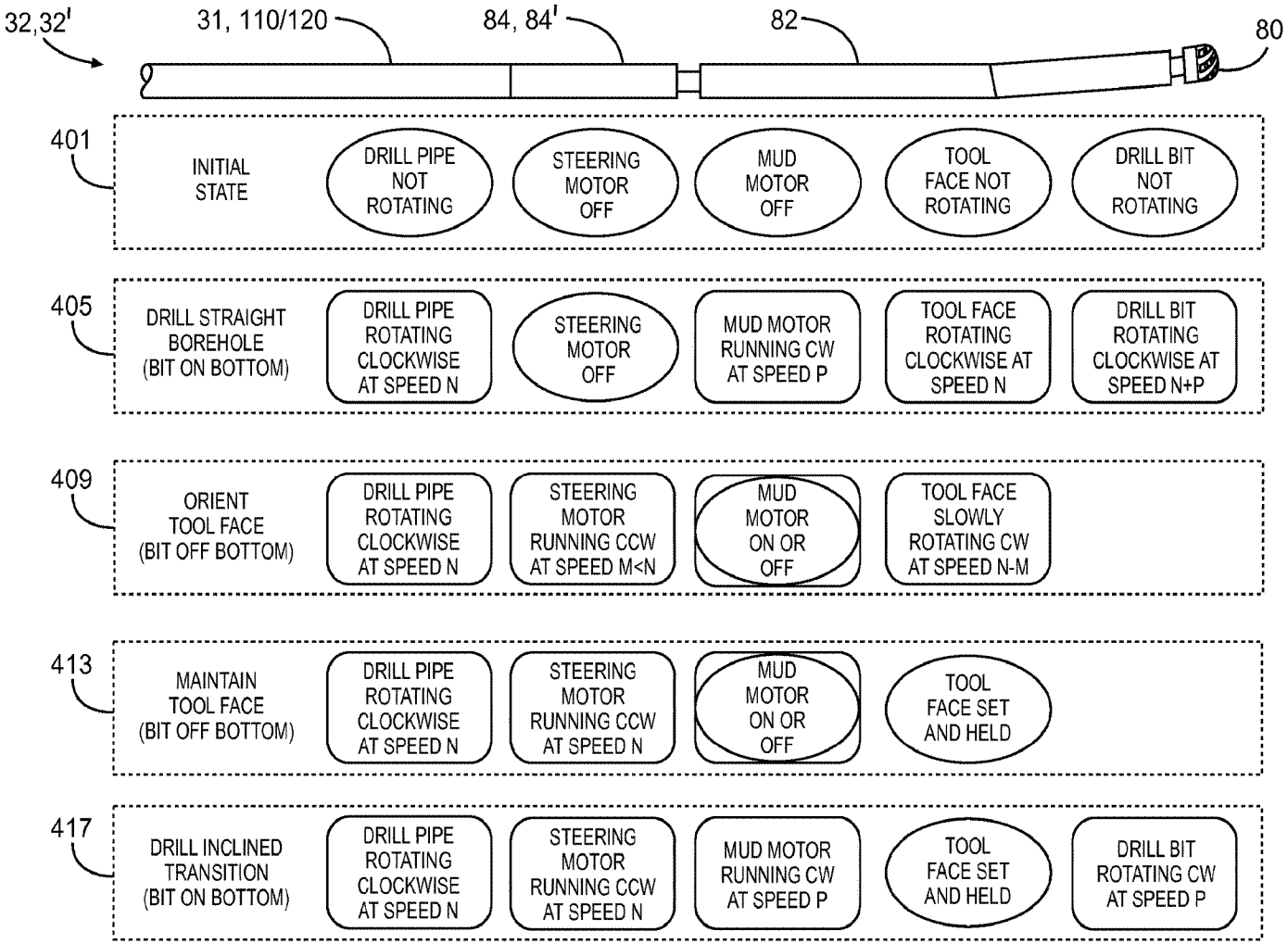
FIG. 11 is a flow chart that illustrates an example method of drilling a wellbore by maintaining a controlled tool face while continuously rotating drill pipe, according to an embodiment.

FIG. 11 is a flow chart that illustrates a drilling method according to an embodiment. Each step in the flow chart is shown as a horizontal box that notes the state or condition of various parts of the drill string 32, 32'. In particular, each step defines the rotation, with respect to the earthen formation, of: Drill pipe 31, 110, 120; the tool face, which is defined by the orientation of bent housing 83 of downhole mud motor 82; and drill bit 80. Rotation of each component is depicted by a rectangle shape, and non-rotation is depicted by an oval shape. Each step also defines whether steering motor 84, 84' and/or downhole mud motor 82 is running, i.e., whether each motor's rotor is rotating with respect to the motor's housing, independently of whether the motor's housing may be rotating with respect to the earthen formation. An "on" or running state is depicted by a rectangle, and an "off" state, in which the rotor does not rotate with respect to the housing, is depicted by an oval shape.

Step 401 shows an initial state of drill string 32, 32' prior to active drilling, in which drill pipe 31, 110, 120 is not rotating and steering motor 84, 84' and downhole mud motor 82 are both in an off state. Accordingly, neither motor housing is rotating, the tool face orientation is not rotating, and drill bit 80 is not rotating.

At step 405, a straight section of wellbore is drilled in a conventional rotary manner. Steering motor 84, 84' remains in an off state. Drill pipe 31, 110, 120 is rotated clockwise at a given speed N, and downhole mud motor 82 is rotated clockwise at a given speed P. According, the motor housings of both steering motor 84, 84' and downhole mud motor 82, and the tool face orientation are all rotated clockwise at speed N by drill pipe 31, 110, 120. Drill bit 80 is rotated clockwise at a combined speed of N+P. Because of the rotating tool face orientation, the wellbore remain straight and is drilled at a slightly enlarged diameter.

When it is desired to drill an inclined transition leg, at step 409 the tool face is first turned to a predetermined orientation. Steering motor is energized and its rotor speed is ramped up counterclockwise to a speed M, which in an embodiment may be slightly slower than the speed N of drill pipe 31, 110, 120 but rotating in the opposite direction. The housing of steering motor 84, 84' rotates clockwise at speed N with respect to the formation, but the housing of downhole mud motor 82, which is driven by the rotor of steering motor 84, 84', rotates clockwise at a very slow speed of N−M with respect to the formation. Accordingly, the tool face orientation may be slowly rotated until it reaches the predetermined orientation. In an exemplary embodiment, a tool face orientation sensor may be used to determine that the tool face orientation has reached the predetermined orientation.

When the tool face orientation reaches its predetermined orientation, at step 413 the predetermined orientation is maintained by running steering motor 84, 84' so that its rotor rotates counterclockwise at speed N—the same speed as drill pipe 31, 110, 120. In an embodiment, a closed loop control system may be provided with a tool face orientation sensor as part of motor controller 370, which may be arranged to continually adjust the rotor speed of steering motor 84, 84' upwards or downwards as necessary to maintain the predetermined tool face orientation.

With the predetermined tool face orientation established and downhole mud motor 82 energized to turn drill bit 80 clockwise at a speed P, at step 417 drill bit 80 is placed on the bottom of the wellbore to drill a curved section of wellbore. As drill bit 80 is placed in bottom, the reactive torque from mud motor 82 causes the tool face to drift counterclockwise as drill string 32, 32' winds up. The speed of steering motor 84, 84' is therefore varied to control the position of the tool face. As the tool face moves counterclockwise, steering motor 84, 84' runs slower than the drill pipe speed. As the tool face moves clockwise, steering motor 84, 84' must match or run faster than the drill pipe to maintain the tool face in the target range. One skilled in the art recognizes that these steps may be rearranged and reordered as required to drill a wellbore according to a desired plan.

In summary, a drilling system, bottom hole assembly, and a method of drilling a wellbore have been described. Embodiments of the drilling system may generally have a drill string including at least one drill pipe, a bottom hole assembly and a drill bit, the bottom hole assembly including a bent housing, a first motor coupled to the drill bit for selectively rotating the drill bit in a first direction, and a steering motor coupled between the first motor and the at least one drill pipe for rotating the first motor in a second direction opposite the first direction. Embodiments of the bottom hole assembly may generally have a drill bit, a first motor coupled to the drill bit for selectively rotating the drill bit in a first direction, the first motor having a bent housing, and a steering motor coupled to the first motor, wherein the steering motor is operable to be rotated in the first direction by a drill pipe and to simultaneously rotate the first motor in a second direction opposite the first direction so as to control an orientation of the bent housing. Finally, embodiments of the method of drilling a wellbore may generally include providing a drill string including at least one drill pipe, a bottom hole assembly and a drill bit, providing within the bottom hole assembly a bent housing, a first motor coupled to the drill bit, and a steering motor coupled between the first motor and the at least one drill pipe, a position of the bent housing defining a tool face orientation, and rotating the at least one drill pipe in a first direction at a first speed while simultaneously rotating a rotor of the steering motor in a second direction opposite the first direction so as to control the tool face orientation.

Any of the foregoing embodiments may include any one of the following elements or characteristics, alone or in combination with each other: The drill string is operable to provide a drilling fluid flow to the first motor; the first motor is a downhole mud motor that is powered by the drilling fluid flow; the steering motor is an electric motor; the drill string is operable to provide a drilling fluid flow to the steering motor; at least a portion of the drilling fluid flow removes heat generated by the steering motor; the drill string includes an inner pipe and an outer pipe, the inner pipe being disposed within the outer pipe and defining an annular flow path therebetween; the drill string includes a flow diverter disposed near the bottom hole assembly that fluidly couples an interior of the inner pipe to an exterior of the outer pipe; the inner pipe form a first electrical conductor coupled to the steering motor for providing electric power thereto; the outer pipe forms a second electrical conductor coupled to the steering motor for providing electric power thereto; a sensor arranged for measuring a rotational speed of the drill string; a motor controller operatively coupled to the sensor and the steering motor and arranged for controlling a rotor speed of the steering motor based on the rotational speed of the drill string; a sensor arranged for measuring a torque of the drill string; a motor controller operatively coupled to the sensor and the steering motor and arranged for controlling a rotor torque of the steering motor based on the torque of the drill string; a sensor arranged for measuring a tool face orientation; a motor controller operatively coupled to the sensor and the steering motor and arranged for controlling the steering motor based on the sensor; the steering motor includes at least one fluid flow path formed therethrough that is arranged for fluid coupling between the drill pipe and the first motor; the first motor is a downhole mud motor; the steering motor is an electric motor that is arranged to receive electrical power from the drill pipe; rotating the drill bit by the first motor; rotating the rotor of the steering motor at the first speed so that the tool face orientation remains constant; rotating the rotor of the steering motor at the second speed that is greater than the first speed so that the tool face orientation rotates in the second direction; rotating the rotor of the steering motor at the second speed that is less than the first speed so that the tool face orientation rotates in the first direction; providing a drilling fluid flow to the first motor via the drill string; powering the first motor by the drilling fluid flow; the steering motor is an electric motor; powering the steering motor by providing electrical current via the at least one drill pipe; and providing a drilling fluid flow to the steering motor via the drill string and cooling the steering motor by at least a portion of the drilling fluid flow.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A drilling system comprising:

a drill string including at least one drill pipe and a drill bit;

a surface drive operable for rotation of the drill string with respect to an earthen formation in a first direction;

a first motor carried along said drill string and coupled between said at least one drill pipe and said drill bit so as to selectively rotate said drill bit in said first direction with respect to said at least one drill pipe, said first motor including a bent housing, a steering motor coupled between said first motor and said at least one drill pipe so as to selectively rotate said bent housing of said first motor in a second direction opposite said first direction with respect to said at least one drill pipe; and a motor controller coupled to said steering motor and arranged so as to control a rotor speed of said steering motor to match a rotational speed of said drill string, the motor controller including commands stored in a memory to rotate said first motor equal in magnitude and opposite in direction with respect to said drill string to thereby maintain a tool face orientation as the drill string rotates.

2. The drilling system of claim 1 wherein:

said at least one drill pipe is in fluid communication with said first motor; and said first motor is a downhole mud motor.

3. The drilling system of claim 1 wherein:

said steering motor is an electric motor.

4. The drilling system of claim 3 wherein:

said at least one drill pipe is in fluid communication with said steering motor.

5. The drilling system of claim 1 wherein:

said drill string includes an inner pipe and an outer pipe, said inner pipe being disposed within said outer pipe and defining an annular flow path therebetween; and the drilling system further comprises a flow diverter that fluidly couples an interior of said inner pipe to an exterior of said outer pipe.

6. The drilling system of claim 5 wherein:

said steering motor is an electric motor;

said inner pipe forms a first electrical conductor coupled to said steering motor; and said outer pipe forms a second electrical conductor coupled to said steering motor.

7. The drilling system of claim 1 further comprising:

a rotational speed sensor coupled to said drill string and operable to determine said rotational speed of said drill string.

8. The drilling system of claim 1 further comprising:

a torque sensor coupled to said drill string; and wherein said motor controller is coupled to said torque sensor and said steering motor and arranged so as to control a rotor torque of said steering motor based on said torque sensor.

9. The drilling system of claim 1 further comprising:

a tool face orientation sensor coupled to said drill string; and wherein said motor controller is coupled to said tool face orientation sensor and said steering motor and arranged so as to control said steering motor based on said tool face orientation sensor.

10. A method for drilling a wellbore in an earthen formation, comprising:

providing a drill string including at least one drill pipe and a drill bit;

providing a first motor carried along said drill string and coupled between said at least one drill pipe and said drill bit;

providing a steering motor coupled between said first motor and said at least one drill pipe, said first motor including a bent housing, a position of said bent housing defining a tool face orientation;

rotating said at least one drill pipe in a first direction with respect to an earthen formation at a first speed;

matching the first speed of the at least one drill pipe with the steering motor; and thereby maintaining said tool face orientation by rotating, simultaneously with rotating said at least one drill pipe in a first direction at a first speed, a rotor of said steering motor in a second direction opposite said first direction to thereby rotate said bent housing of said first motor at said first speed in said second direction.

11. The method of claim 10 further comprising:

rotating said drill bit by said first motor.

12. The method of claim 10 further comprising:

rotating said rotor of said steering motor at said first speed so that said tool face orientation remains constant.

13. The method of claim 10 further comprising:

providing a drilling fluid flow to said first motor via said drill string; and powering said first motor by said drilling fluid flow.

14. The method of claim 10 wherein:

said steering motor is an electric motor; and the method further comprises powering said steering motor by providing electrical current via said at least one drill pipe.

15. The method of claim 10 wherein:

said steering motor is an electric motor; and the method further comprises providing a drilling fluid flow to said steering motor via said drill string and cooling said steering motor by at least a portion of said drilling fluid flow.

16. The method of claim 10 further comprising adjusting the tool face by providing a mismatch in speed between the at least one drill pipe with the steering motor until the tool face is in a target range.

17. The method of claim 10 further comprising continuously rotating the bent housing with respect to the at least one drill pipe such that the bent housing does not rotate with respect the earthen formation to drill a curved section of the wellbore.

18. A bottom hole assembly connectable in a drill string for drilling a wellbore in an earthen formation, comprising:

a drill bit;

a first motor coupled to said drill bit so as to selectively rotate said drill bit in a first direction, said first motor having a bent housing;

a steering motor coupled to said first motor so as to selectively rotate said bent housing of said first motor in a second direction opposite said first direction; and a motor controller operable to determine a rotational speed of said drill string and to operate said steering motor, said motor controller including commands stored in a memory to rotate said bent housing of said first motor in the second direction, at a rotational speed matching the magnitude of said rotational speed of said drill string, to thereby maintain a tool face orientation as the drill string rotates.

19. The bottom hole assembly of claim 18 wherein:

said steering motor includes at least one fluid flow path formed therethrough that is arranged for fluid coupling between a drill pipe of said drill string and said first motor; and said first motor is a downhole mud motor.

20. The bottom hole assembly of claim 18 wherein:

said steering motor is an electric motor that is arranged to receive electrical power from an inverter circuit operable for switching and alternating the polarity of current to pairs of windings in the steering motor.

* * * * *